United States Patent [19]

Schaumann

[11] Patent Number: 4,541,809

[45] Date of Patent: Sep. 17, 1985

[54] WATER GLIDER ASSEMBLY

[76] Inventor: Peter H. Schaumann, Apt. 1-D, 6940 Roswell Rd., Atlanta, Ga. 30328

[21] Appl. No.: 628,906

[22] Filed: Jul. 9, 1984

Related U.S. Application Data

[63] Continuation-in-part of Ser. No. 321,474, Nov. 16, 1981, Pat. No. 4,459,118.

[51] Int. Cl.[4] ..... A63C 15/02

[52] U.S. Cl. ..... 441/76; 441/77

[58] Field of Search ..... 441/76, 77; 308/6 R, 308/3.8; 280/218, 11.15

[56] References Cited

U.S. PATENT DOCUMENTS

| | | | |
|---|---|---|---|
| 1,528,309 | 3/1925 | Steuerlein | 441/77 |
| 2,153,939 | 4/1939 | Schaupp | 441/77 |
| 3,084,356 | 4/1963 | Wheat | 441/77 |
| 3,121,892 | 2/1964 | Plumlee | 441/77 |
| 3,936,897 | 2/1976 | Schaumann | 441/77 |

*Primary Examiner*—Trygve M. Blix

*Assistant Examiner*—C. T. Bartz

*Attorney, Agent, or Firm*—Watson, Cole, Grindle & Watson

[57] ABSTRACT

A water glider assembly includes two water glider members and a separate elongated stabilizer cartridge which can be inserted between the glider members to connect them together and eliminate not only lateral and vertical separations, but also individual sideways rotation of each glider member, while at the same time allow for free parallel movements therebetween. One or the other of the glider members can be partially disconnected from the stabilizer cartridge during use of the assembly so that its direction of orientation can be changed, thereby enabling the user to easily change the direction of movement of the assembly as a whole. The stabilizer cartridge is provided with a releasable locking mechanism for alternately locking the stabilizer cartridge to both water glider members for assembly and transportation as well as alternately locking the stabilizer to one water glider member when the assembly is in use for gliding on water.

14 Claims, 12 Drawing Figures

WATER GLIDER ASSEMBLY

CROSS-REFERENCE TO RELATED APPLICATION

This Application is a continuation-in-part application of application Ser. No. 321,474, filed Nov. 16, 1981. Now Pat. No. 4,459,118; issued 7/10/84.

BACKGROUND OF THE INVENTION

1. Field of the Invention

The present invention relates to water glider assemblies of the type which include separate left and right foot water glider members that can support an individual user above the surface of a body of water and enable the user to move thereacross, and more particularly to such water glider assemblies wherein the separate water glider members are connected together by attachment devices so as to stabilize the assembly.

2. The Prior Art

Water glider members, which are also variously known as water walkers, water shoes, water skis, flotation members and pontoons, are well known elements for use in supporting an individual user above the surface of a body of water and for enabling the user to move from one point to another on the water's surface while standing up. Usually two separate water glider members are used together, one being a left foot water glider member for supporting the left foot and leg of a user and the other being a right foot water glider member for supporting the right foot and leg of the user, and advantageously these separate water glider members are connected together by suitable attachment devices so as to form a water glider assembly which is stable. Without the use of such interconnecting attachment devices it is difficult, and at times unsafe, for a user to stand on the individual glider members or use them to propel himself forward. In this regard, unconnected pairs of glider members will tend to separate laterally due to the fact that the center of gravity of the individual user will be located between the member pairs; they will tend to separate vertically as the weight of the individual user shifts from one glider member to the other during use; and they will individually tend to rotate from side to side, especially when used in rough water conditions. Prior art water glider assemblies have utilized many different types of attachment devices for connecting the water glider member pairs together, some achieving a greater degree of stability in the glider assemblies than others.

Some water glider assemblies simply utilize flexible connecting lines between the two water glider members. For example, in U.S. Pat. No. 2,694,209, two water skis are connected at their leading and trailing ends by link chains. In U.S. Pat. No. 3,835,494, two water walking pontoons are connected in side by side relationship by a series of elastic chords. However, although these types of water glider assemblies display a certain degree of stability as compared to systems wherein the water glider members are not connected atall, the connecting lines must be relatively short in order to limit the lateral and vertical movements between the glider members, and this shortness in length will likewise limit the relative parallel displacement obtainable between the glider members and thus will reduce their effectiveness in moving an individual user across the water's surface. In addition, the sideways rotation of the separate glider members is not at all effectively controlled.

An improved water glider assembly of the foregoing type is shown in my prior U.S. Pat. No. 4,261,069 wherein two water walker members of a water walker assembly are not only connected by two looped cables but are interengaged by means of an enlarged protrusion which extends outwardly from the side of one of the water walker members to engage in an elongated indentation in the facing side of the other water walker member. However, although this water walker assembly is improved in stability insofar as the positioning of the protrusion in the side of one walker member in the indentation in the other reduces the possible vertical separations between the two glider members and helps to some degree in controlling their individual sideways rotation, the looped cables will by necessity limit the possible relative parallel displacement between the water walker members and thus will limit the ability of the user of the walker assembly to move it forward.

A number of prior art water glider assemblies utilize guide rods which extend in parallel between the individual glider members to provide stability to the assembly. In U.S. Pat. No. 2,153,939, inclined rods are respectively attached to the facing sides of two water skis and loop elements are interconnected between the rods to allow the two skis to be moved in parallel with one another while lateral and vertical separations are prevented. In U.S. Pat. No. 3,112,892, an elongated rod is located in parallel between two skis to fit through slotted projections extending outwardly from the facing sides of the two skis to likewise allow for parallel movement between the two skis while prohibiting lateral and vertal displacements therebetween. However, in neither of these water glider assemblies are the individual glider members fully prevented from individual sideways rotation, and in addition, due to their construction, these assemblies must be either stored and shipped in the form of a single unit (which is cumbersome) or else are assemblable for use only with the help of accessory tools.

Finally, in U.S. Pat. No. 3,877,409, a water glider assembly is shown wherein the individual water skis are connected together by guide rails and cooperating bearing elements which project from facing sides of the two skis, as well as by a separate rod member which is pivotally interconnected to vertically oriented bracket members on the top surface of each ski. However, although this water glider assembly is quite stable because of the fact that the individual skis are limited with respect to lateral and vertical displacements and also because they are prevented from individual sideways rotation, the assembly is quite complicated in structure and requires supplementary equipment in order to control the direction of movement of the glider assembly.

Thus, many of the known water glider assemblies are undesirable because the stabilizing attachment devices used to connect the individual glider members either will be insufficiently effective, undesirably limiting with regard to the parallel displacement between the glider members, undesirably complicated in structure, or difficult to store, transport and assemble. In addition, none of the prior art water glider assemblies are constructed to allow the user to partially disconnect the two individual glider members in order to change the direction of movement of the assembly while in use.

It is thus an object of the present invention to provide a water glider asembly which is stable, i.e., wherein lateral and vertical displacements between the individual water glider members are prevented and wherein sideways rotation of each water glider member is prevented, but which nevertheless allows the individual water glider members to freely move in parallel with respect to one another.

It is a further object of the present invention to provide such a water glider assembly wherein the individual water glider members thereof can be easily redirected in orientation to change the direction of movement of the water glider assembly as a whole.

It is also an object of the present invention to provide a water glider assembly which is simple in construction, easy to store and transport, and readily assembled without the need for accessory tools.

It is a further object of the present invention to provide a water glider assembly having a stabilizer cartridge which includes a releasable locking mechanism for the cartridge so as to help prevent stabilizer cartridge creep and to facilitate assembly and transportation of the water glider assembly.

It is yet another object of the invention to provide a water glider assembly which can be propelled over the surface of water by forces exerted by both the arms and legs of the user.

SUMMARY OF THE PRESENT INVENTION

According to the present invention, the inventive water glider assembly includes a pair of water glider members, a separate elongated stabilizer cartridge which is slidably connectable between the two water glider members when they are positioned in close side-by-side relationship, and a releasable locking mechanism means for alternately locking the stabilizer cartridge to either of the water glider members and for releasing the stabilizer cartridge from the locked water glider member upon a forward movement of the other water glider member relative to the locked water glider member. The respective water glider members preferably include identical indented steps in their facing sides which extend from their leading ends toward their trailing ends, and mounted in each indented step are a number of guide elements which are constructed to coact with the stabilizer cartridge when inserted therethrough to prevent not only lateral and vertical separation between the water glider members, but also sideways rotation of the individual glider members, while at the same time allow for free parallel movements therebetween. Preferably the locking mechanism means comprises two spring-like locking fingers carried by the stabilizer cartridge, stop means carried on each of the water glider members, the stop means engagable with the locking fingers to lock the stabilizer cartridge to a water glider member, and release means on each water glider member for releasing the locking finger engaged with a stop means carried by the other water glider member.

A further understanding of the invention will be now achieved by reference to the accompanying drawings taken in conjunction with the following discussion.

DETAILED DESCRIPTION OF THE PREFERRED EMBODIMENTS

Figure 1:
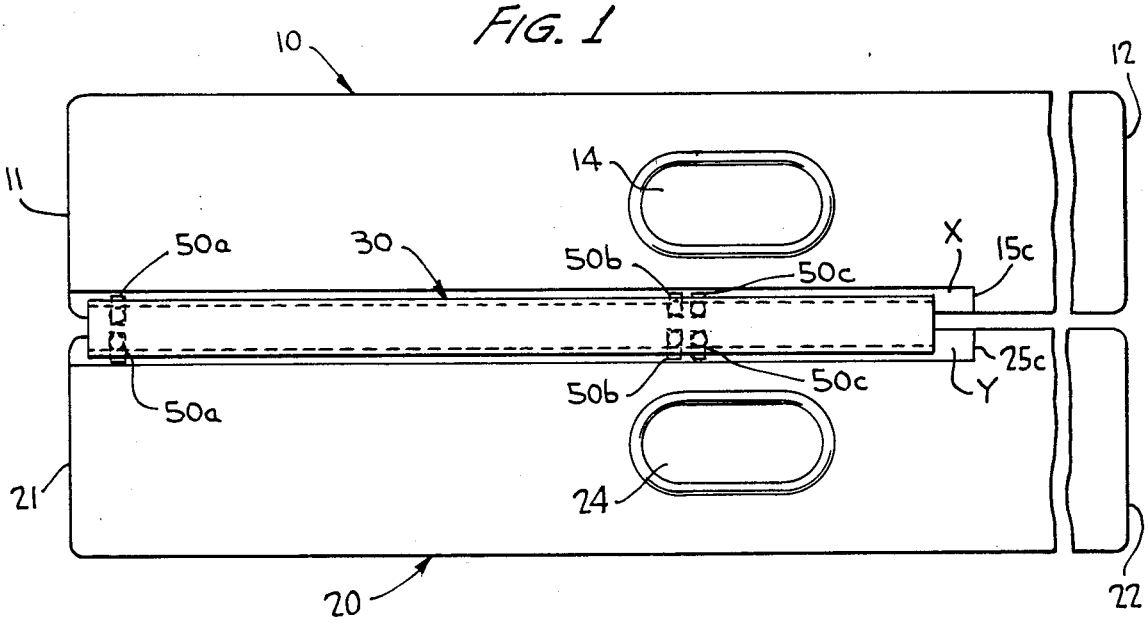
FIG. 1 shows a top plan view of a water glider assembly constructed in accordance with the present invention, the assembly including a pair of water glider members and an interconnecting stabilizer cartridge.

As shown in FIG. 1, the water glider assembly of the present invention includes a right foot water glider member 10, a left foot water glider member 20 and an interconnecting elongated stabilizer cartridge 30. The right foot water glider member is seen to include a leading end 11, a trailing end 12, a top surface 13, a foot cavity 14, and a left side surface 15. The left foot water glider member 20 likewise includes a leading end 21, a trailing end 22, a top surface 23, a foot cavity 24 and a right side surface 25. When the left and right foot water glider members 10 and 20 are positioned next to each other so as to allow the stabilizer cartridge to be inserted (and connected) therebetween, the left side surface 15 of glider element 10 will face the right side surface 25 of glider element 20.

Figure 4:
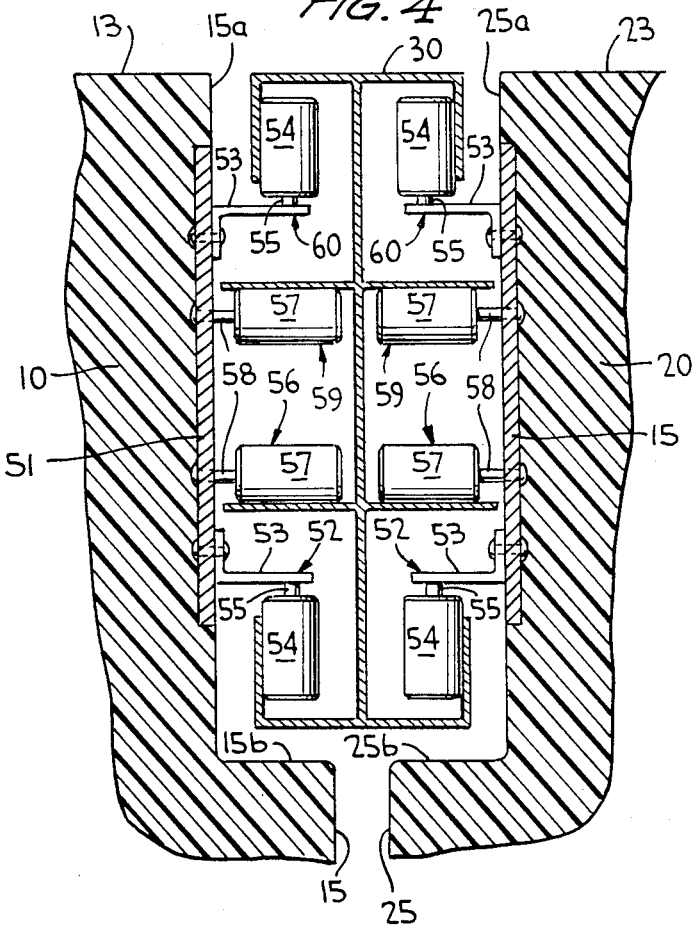
FIG. 4 shows a cross-sectional view of the water glider assembly as seen along line 4—4 of FIG. 3.

As best seen in FIGS. 1 and 4, both the left side surface 15 of glider member 10 and the right side surface 25 of glider member 20 are constructed to have indented stops which extend from the respective leading ends 11 and 21 of the glider members to points located rearwardly of the respective foot cavities 14 and 24 (which themselves will be located at about the midway point between the leading ends of the glider members and the trailing ends). The indented steps in the two glider assemblies are formed by respective vertical wall portions 15*a* and 25*a* which extend downwardly from the respective top surfaces 13 and 23, respective horizontal wall portions 15*b* and 25*b*, and rearward wall portions 15*a*, 15*b* and 15*c* in glider member 10 and wall portions 25*a*, 25*b* and 25*c* in glider member 20 create respective elongated channels X and Y along the facing sides of the respective glider members which are open at their forward ends, their tops and their sides and extend from the leading ends 11 and 21 of the respective glider members to their rearward wall portions 15*c* and 25*c*.

Mounted on each of the respective vertical wall portions 15*a* and 25*a* of the glider members 10 and 20 are three identical guide elements 50*a*, 50*b* and 50*c*. Each guide element is dimensioned to fit within the associated channel X or Y, and as shown in FIG. 1, each of the guide elements 50*a* are identically located near the leading ends of the glider members 10 and 20 while the guide elements 50*b* and 50*c* are identically located near one another at about the midway point between the leading and trailing ends of each glider member.

Referring now to the specific construction of the guide elements, as seen in FIG. 4 each includes a base plate 51, which is mountable on the associated vertical wall portion of the glider member by suitable means (not shown), and four roller assemblies 52, 56, 57 and 60 which are located in spaced apart fashion between the upper and lower ends (as seen in FIG. 4) of the base plate. The lowermost roller assembly 52, which is attached to the base plate 51 near its lower edge (as shown in FIG. 4), includes a mounting bracket 53, a cyclindrical roller 54 and a roller shaft 55. The mounting bracket 53, which has an L-shaped cross section, has its foot portion attached to the base plate 51 such that its leg portion extends perpendicularly away from the base plate. One end of the roller shaft 55 is attached to the leg portion of the mounting bracket so as to extend in parallel with the base plate 51 and the cylindrical roller 54 is rotatably mounted on the opposite (free) end of the roller shaft 55 such that it extends downwardly and away from the other roller assemblies. The uppermost roller assembly 60 is identical to the roller assembly 52 except that it is attached to the base plate 51 near its upper edge and is oriented such that its cylindrical roller 54 extends upwardly and away from the other roller assemblies. On the other hand, the two middle roller assemblies 56 and 59, which are identical, include a cylindrical roller 57 and a roller shaft 58. One end of the roller shaft 58 is connected to the base plate 51 to extend perpendicularly away therefrom and the cylindrical roller 57 is rotatably attached to its opposite (free) end.

The roller assemblies of each guide elements are suitably dimensioned and appropriately positioned along between the upper and lower edges of the base plate 51 (as seen in FIG. 4) so as to abut against the cooperating parts of the stabilizer cartridge when it is extended therethrough.

Figure 2:
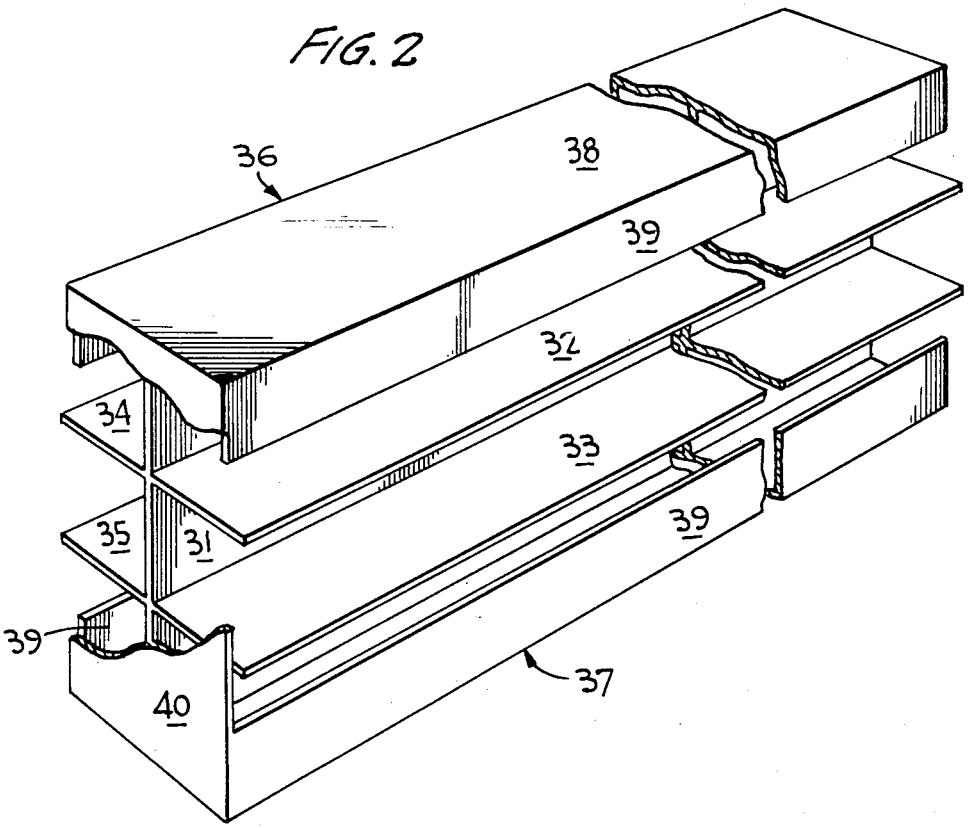
FIG. 2 shows a perspective view, partially broken away, of the stabilizer cartridge shown in FIG. 1.
Figure 3:
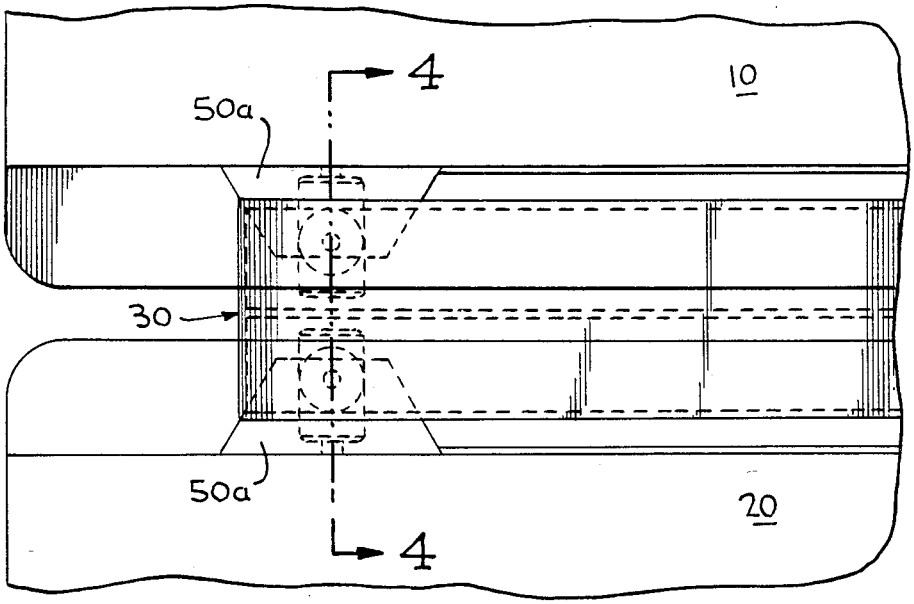
FIG. 3 shows a detailed top view of the structure found in area A of FIG. 1.

Turning now to the structure of the elongated stabilizer cartridge 30, as shown in FIGS. 2 and 4 it is seen to include a flat center member 31, a first pair of flat rib members 32, 33 which extend perpendicularly outwardly from one side of the center member 31, a second pair of flat rib members 34, 35 which extend perpendicularly outwardly from the opposite side of the center member 31, and two cap members 36, 37 which are respectively connected to the upper and lower edges of the center member 31. Each of the cap members includes a flat floor portion 38 and flat flange portions 39 which extend in the same direction perpendicularly away from the opposite side edges of the flat floor portion 38. The cap member 36 is attached to the upper edge (as seen in FIGS. 2 and 4) of center member 31 along the center of the flat floor portion 38 and such that its flange portions 39 extend downwardly towards the rib members 32 and 34. The cap member 37 is correspondingly attached to the lower edge of center member 31 such that its flange portions 39 extend upwardly towards the rib members 33 and 35. The stabilizer element also includes at its front end a flat closure member 40 which is connected to the front ends of all the members 31–39 so as to completely enclose the front end of the stabilizer cartridge. The opposite (rear) end of the stabilizer cartridge is left open. As can be seen from FIG. 1, the stabilizer cartridge is sufficiently elongated that when inserted between the two glider members 10 and 20, it will extend from the guide elements 50*a* of each glider member rearwardly along channels X and Y to corresponding points behind the guide elements 50*c*. The stabilizer cartridge will cooperate with the guide elements of each glider member such that the cylindrical rollers 53 will be in rolling contact with the inner sides of flat flanges 39 and the cylindrical roller 57 will be in rolling contact with the facing sides of flat rib members 32, 33 and 35, 36. Such engagements between the cylindrical rollers of the guide elements and the noted parts of the stabilizer cartridge will completely eliminate not only lateral and vertical displacements between the two glider members but also individual sideways rotation of either glider member, while at the same time allow for free parallel movement therebetween.

In a typical embodiment of water glider assembly constructed in accordance with the present invention, the two glider members will be about 60 inches in length, the indented steps along their facing sides will extend rearwardly of their leading ends by about 50 inches and the guide elements will be positioned in the indented steps such that the guide elements 50*a* are about two inches rearwardly of their leading ends while the guide elements 50*b* and 50*c* are positioned about two inches apart at a point about 30 inches rearwardly of the leading ends. The stabilizer cartridge, which can be constructed of extruded aluminum, will be about 47 inches in length.

The water glider assembly of the invention can be assembled from the individual components as follows: the right and left foot water glider members 10 and 20 are oriented in parallel such that their respective side walls 15 and 25 face one another. Then the stabilizer cartridge is centrally placed in front of the glider members so as to be parallel therewith, the open rear end of the stabilizer cartridge being closest to the glider members. The stabilizer cartridge is then inserted into the channels X and Y of the glider members and sequentially inserted in and through the respective guide elements 50*a*, 50*b* and 50*c* until the flat closure member 40 of the stabilizer cartridge contacts the guide elements 50*a* (see FIG. 2). The water glider assembly can then be conveyed as a unit to the body of water in which it is to be used and then mounted by the user.

In use, the person who is standing on the individual glider members can move himself along the water's surface by alternately moving his legs forward in a gliding motion so as to move the glider members in parallel with one another. No lateral or vertical separations between the two glider members will occur and neither glider member will separately rotate to cause the user to lose his balance; thus the assembly will be quite stable, even in rough water. The stabilizer cartridge 30 will remain in place by the water pressure exerted on the flat closure member 40. When the user wishes to adjust or reverse his direction of movement, one glider member is moved in parallel with respect to the other sufficiently that the open rear end of the stabilizer cartridge will disengage from the guide elements 50*b* and 50*c* on the rearward glider member and the forward glider member (and stabilizer cartridge) pivoted about the guide element 50*a* on the rearward glider member such that the new direction of movement is determined. The rearward glider member is then swung into alignment with the forward glider member, the rearward glider member is then moved forward such that the stabilizer cartridge is again engaged with its guide elements 50*b* and 50*c*, and the gliding motion of the user's legs renewed.

Figure 5:
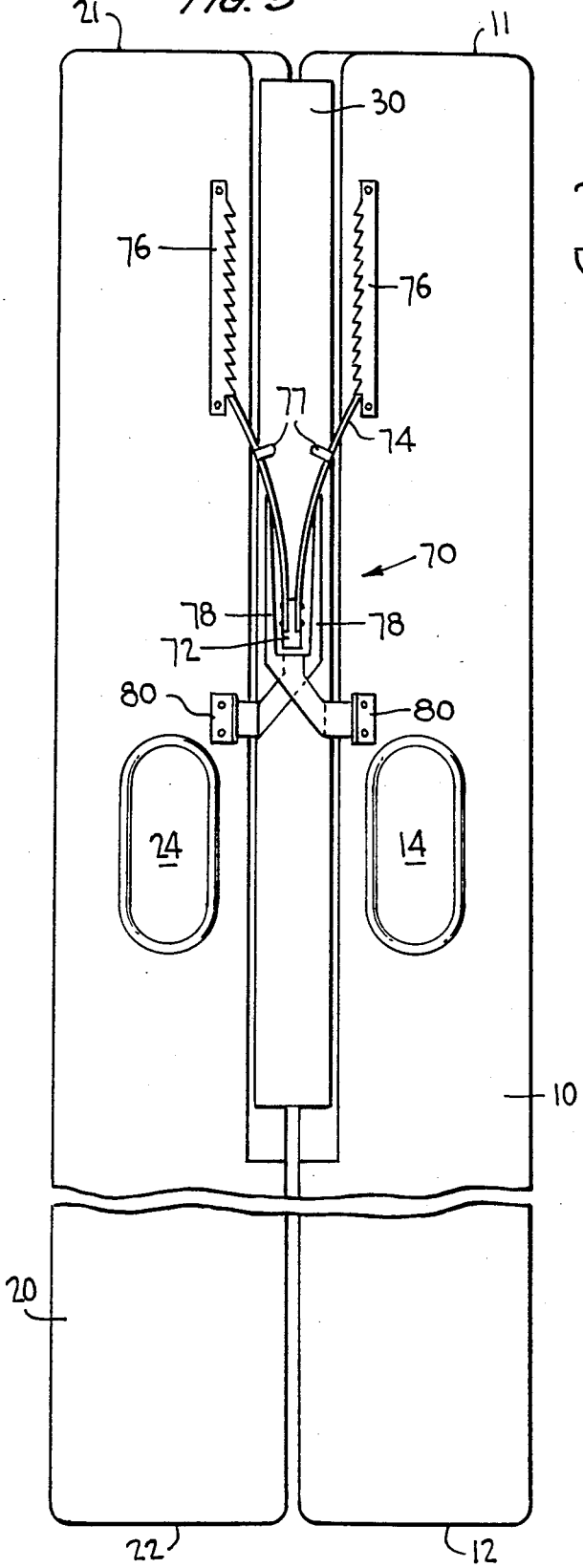
FIG. 5 shows a top plan view of another embodiment of a water glider assembly constructed in accordance with the present invention, the assembly including a stabilizer cartridge having a releasable locking mechanism for locking the cartridge to at least one of the water glider members.

Turning now to FIG. 5, shown is another embodiment of a water glider assembly of the present invention. Like the previously described embodiment, the water glider assembly includes right foot water glider number 10, left foot water glider member 20 and interconnecting elongated stabilizer cartridge 30. Releasably locking stabilizer cartridge 30 to one or both of water glider members 10 and 20 is locking mechanism 70.

Figure 7:
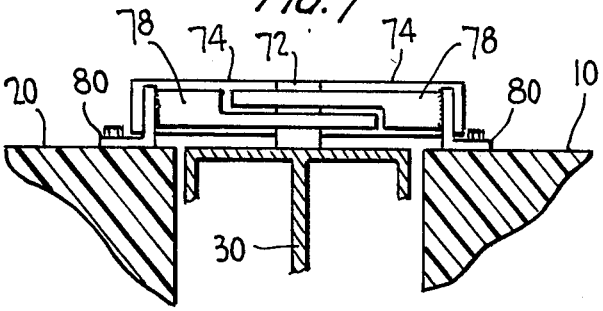
FIG. 7 shows a partial cross-sectional view of the water glider assembly showing the locking mechanism, the view being taken along line 7—7 of FIG. 6.
Figure 6:
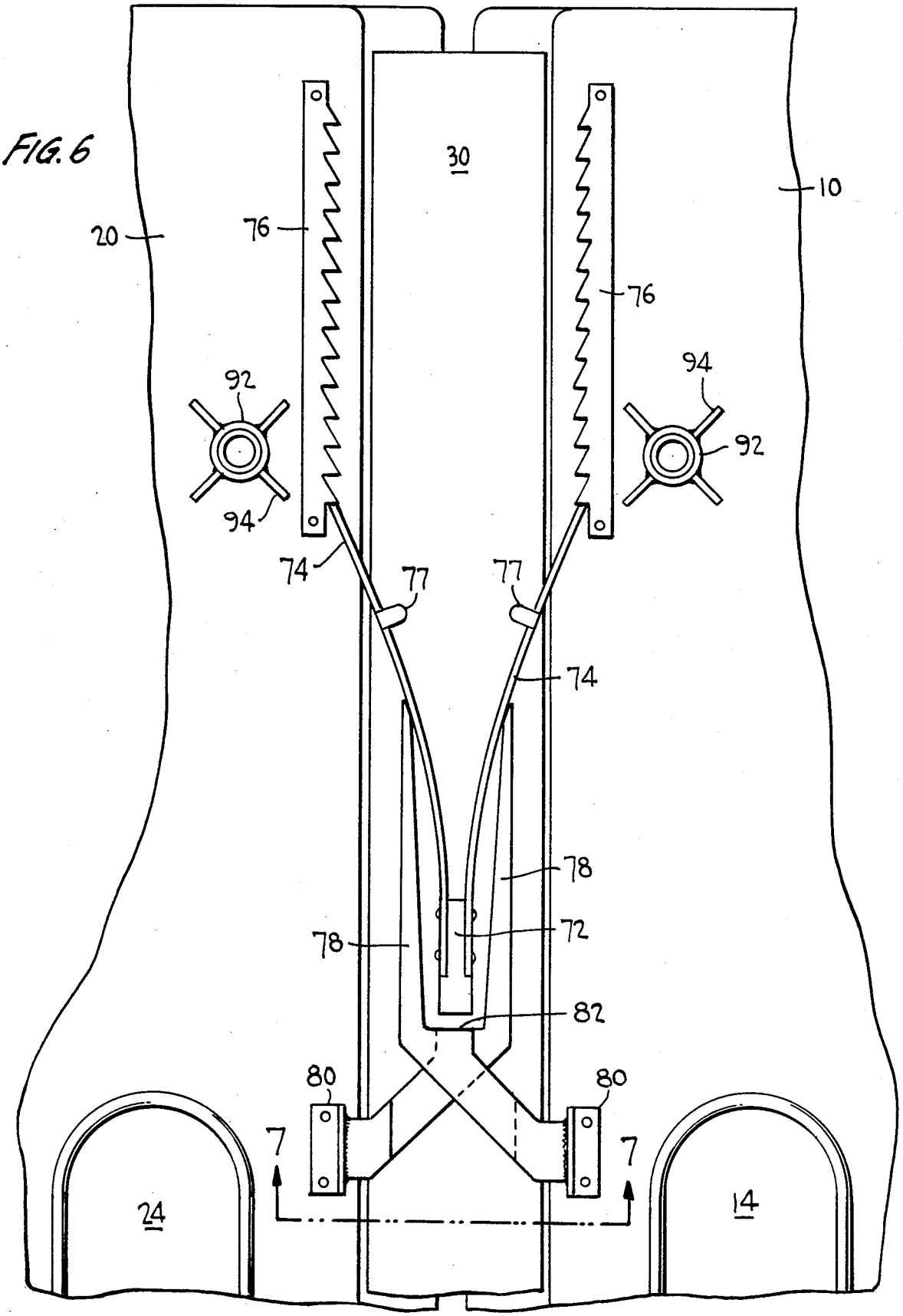
FIG. 6 shows an enlarged, detail top view of the locking mechanism of FIG. 5.
Figure 8:
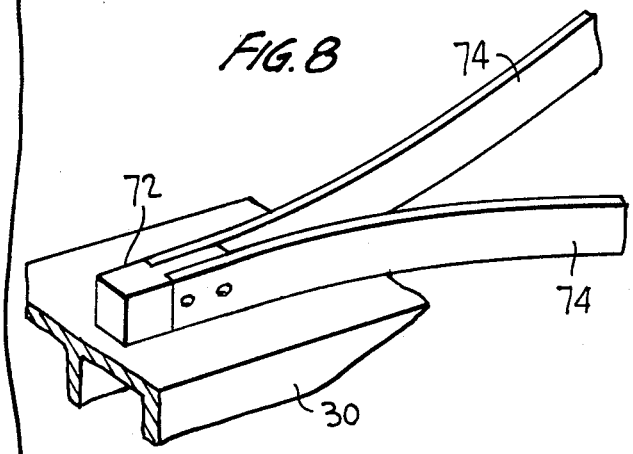
FIG. 8 is a perspective view, partially broken away, of the portion of the locking mechanism attached to the stabilizer cartridge.

As is more clearly shown in FIGS. 6, 7 and 8, releasable locking mechanism 70 comprises post 72 projecting upwardly from stabilizer cartridge 30, the post having two horizontal, resilient spring-like locking fingers 74 attached thereto. Locking fingers 74 extend toward respective leading ends 11 and 21 of the water glider members 10 and 20 and are of a curved configuration such that they diverge from one another as the fingers extend from post 72. The ends of locking fingers 74 are adapted to engage a stop in the form of teeth of ratchet bars 76 which are fixedly attached to the top surface of each of water glider members 10 and 20. Preferably the teeth of ratchet bar 76 are configured such that stabilizer cartridge 30 can be moved rearwardly, i.e., toward trailing ends 12 and 22 while the ends of fingers 74 are engaging the ratchet bar. Each locking finger 74 has tab 77 on its upper surface, the two tabs together providing a convenient means for manually squeezing fingers 74 toward each other and thus disengaging the fingers from ratchet bars 76.

For automatically releasing fingers 74 from engagement with ratchet bars 76, during use of water glider assembly, each of water glider members 10 and 20 is provided with release arm 78 extending generally horizontally toward leading ends 11 and 21 of water glider member 10 and 20. Each release arm 78 is fixedly attached to water glider members 10 and 20 respectively by mounting plate portion 80 and includes striking surface 82 adapted to contact the rear surface of post 72 so as to carry stabilizer cartridge 30 with a forward movement of the water glider member. Release arms 78 are of a length such that as striking surface 82 contacts post 72, the forward tip of the release arm simultaneously contacts locking finger 74 and biases the finger out of engagement with ratchet bar 76.

Figure 11:
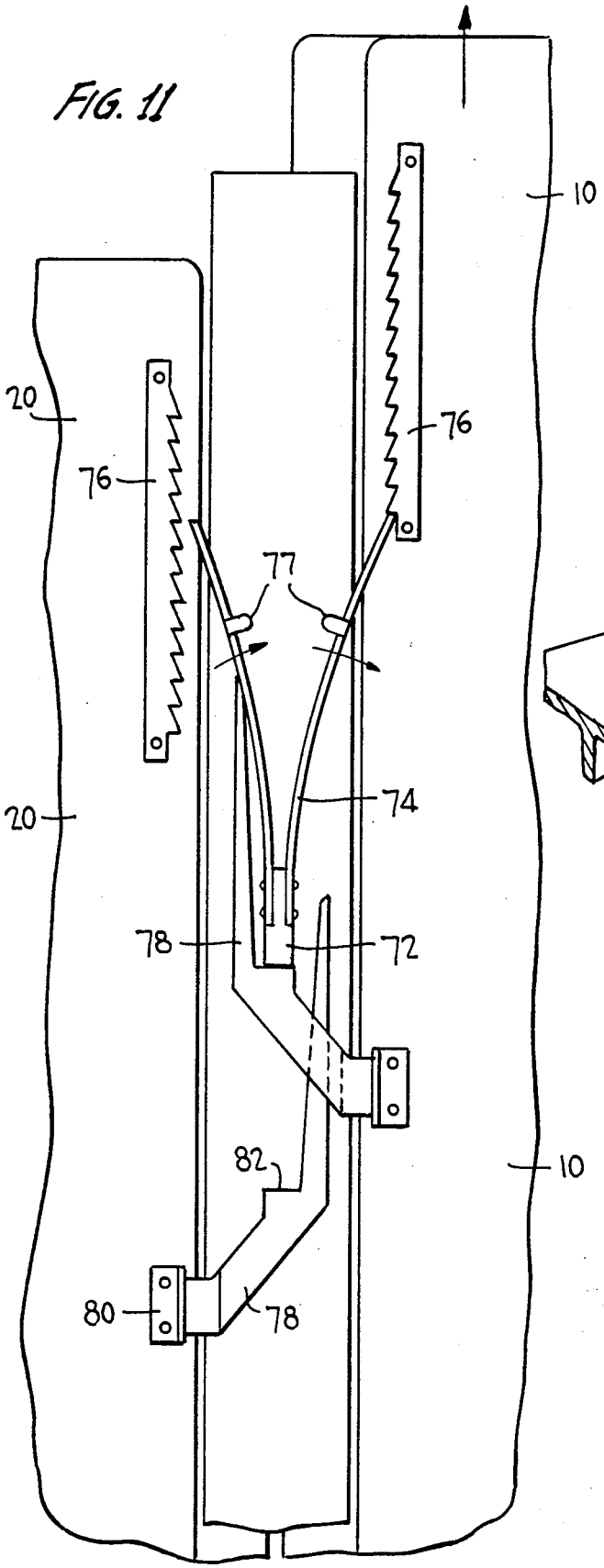
FIGS. 9–11 show the operation of the locking mechanism during relative movement between the water glider members of the water glider assembly.
Figure 9:
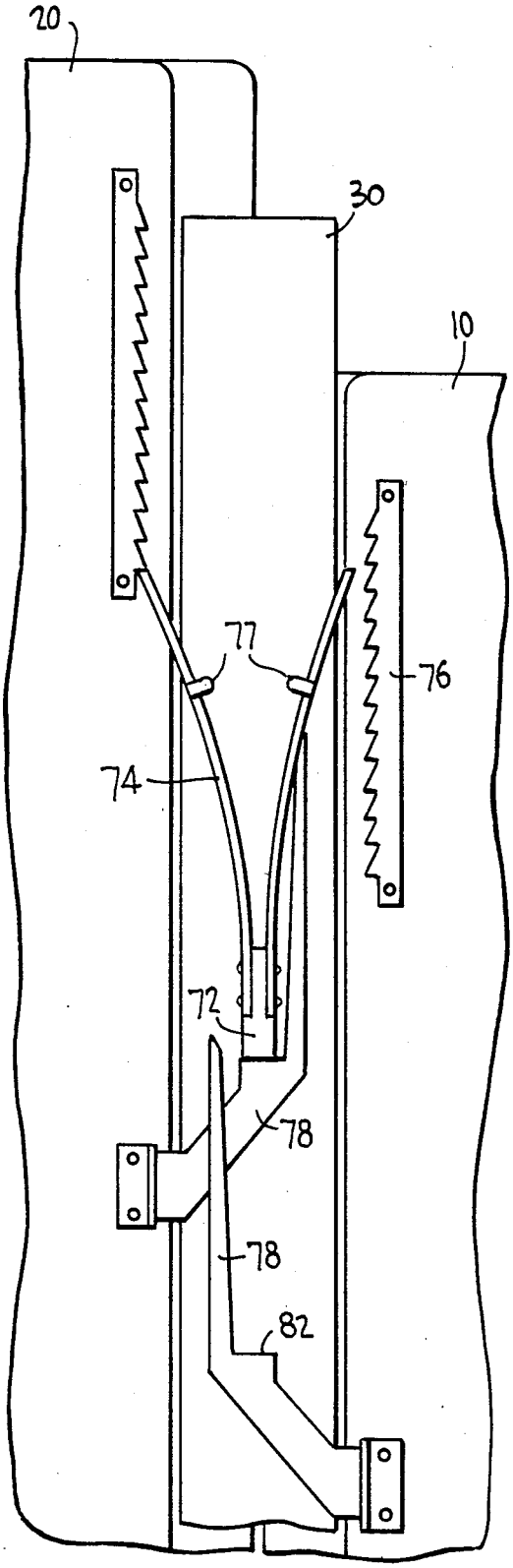
Figure 10:
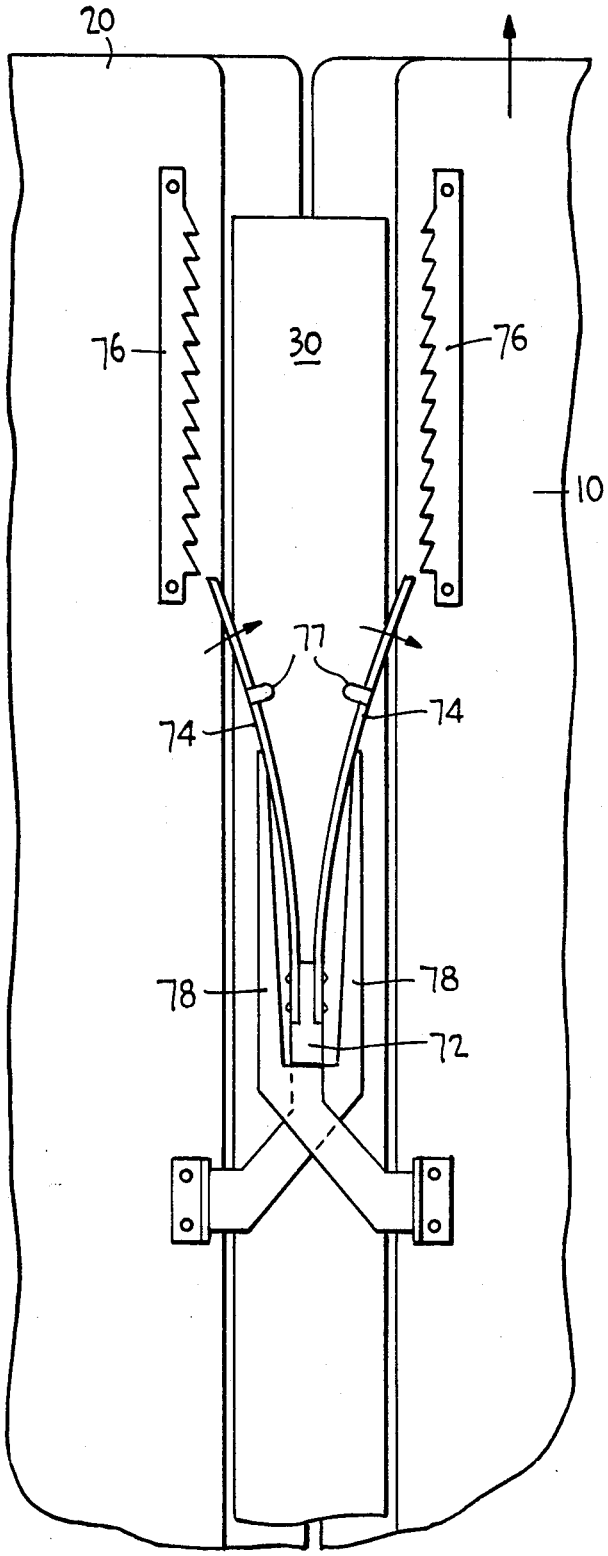

The operation of releasable locking mechanism 70 during water gliding is illustrated in FIGS. 9–11. Initially, the user of the water glider assembly will assume a position such that water glider members 10 and 20 are approximately even with each other as is shown in FIG. 5. The user then pushes forward with either foot and propels the water glider member engaged therewith in the same direction. In FIG. 8, left water glider member 20 is shown to have been pushed forward relative to right water glider member 10. As left water glider member 20 moves forward, attached striking surface 82 of attached release arm 78 contacts post 72 and thus carries stabilizer cartridge 30 along with the forward movement of the left glider member. During the stride, release arm 78 of left foot water glider member 70 also biases locking finger 74 projecting toward right foot water glider number 10 out of engagement with ratchet bar 76 of the right foot member. Finger 74 engaging ratchet bar 76 on left water glider member prevents stabilizer cartridge 30 from continuing to move in the forward direction by its own momentum once the stride is completed.

Thereafter, the stride for right foot water glider member 10 is commenced. At about the midpoint of the stride for right foot glider member 10, striking surface release arm 78 carried by the member right foot contacts post 72 and starts stabilizer cartridge 30 moving along with the right foot member. Simultaneously, the end portion of release arm 78 carried by right foot member 10 biases locking finger 74 away from engagement with ratchet bar 76 on left foot member 20. As soon as stabilizer cartridge 30 begins to move forward, locking finger 74 projecting toward right foot glider member 10 will no longer be biased by release arm 78 carried by left foot member 20 and the locking finger will engage ratchet bar 76 on the right foot member. FIG. 10 shows the water glider assembly at the completion of the stride for right foot water glider member 10 with stabilizer cartridge 30 locked to the right foot member by striking surface 82 contacting post 72 and locking finger 74 engaging ratchet bar 76.

As is apparent from the above discussion, one release arm 78 of a water glider member provides two functions, i.e., to contact post 72 so as to propel stabilizer cartridge 30 in a forward direction and to release locking finger 74 from the teeth of ratchet bar 76 of the other water glider member. It should be realized that these two functions would be accomplished by two or more components carried on each water glider member.

A releasable locking mechanism according to the present invention provides several advantages in the operation and use of a water glider assembly having a stabilizer cartridge. First, during assembly of the water glider assembly where the stabilizer cartridge is inserted in the bow end of the elongated channels of the left and right foot water glider members, the locking fingers engage the teeth of both the ratchet bars and thus lock the stabilizer cartridge relative to the two water glider members. Having the stabilizer cartridge locked enables the water glider assembly to be assembled on a surface which slopes downwardly toward the front of the assembly and enables the assembled water glider to be transported in other than a horizontal position, where the cartridge would, without the provision of locking mechanism, tend to roll back out of engagement with the channels of the water glider members by the force of gravity. By having the ratchet bars contain a significant number of teeth as is shown, it is not necessary to have the two water glider members exactly abreast to be able to lock stabilizer cartridge to both the water glider members. The stabilizer cartridge can be easily removed from between the water glider members during disassembly and the like by manually squeezing locking fingers 74 using tabs 77 such that they disengage from ratchet bars 76 and then rolling the stabilizer cartridge towards the bow of the water glider members.

Second, and perhaps more importantly, the locking mechanism of the invention provides greater stability for the water glider assembly when gliding over the surface of water. Without the use of a locking mechanism, the stabilizer cartridge tends to creep out of the proper position relative to the two water glider members during the respective striding movement of the members. This creeping of the stabilizer cartridge during the striding movement may be due to the friction of the rollers on moving water glider member sometimes being greater than the holding friction of the rollers of the stationary water glider member. By using a releasable locking mechanism according to the invention, the stabilizer cartridge will always be maintained in a proper position relative to the two water glider members.

Figure 12:
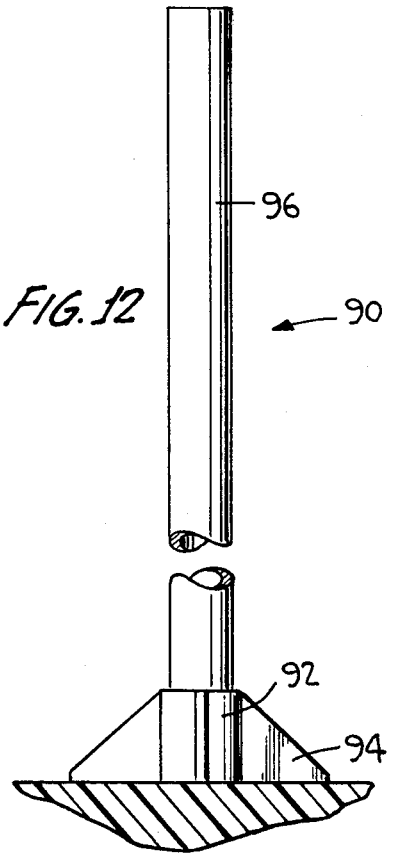
FIG. 12 shows a detail view of a manual push bar for use in assisting a water glider member to move over the surface of water and to help maintain the balance of a user.

Referring now to FIG. 12, shown is push bar 90 which comprises another aspect of the present invention. Push bar 90 includes socket 92 fixedly attached to upper surface 13 or 23 of a water glider member 10 or 20. Socket 92 has a plurality of ribs 94 for reinforcement purposes and is adapted to receive an end of elongated rod 96. Socket 92 is attached to upper surface 13 or 23 of the water glider member at a position in front of foot cavity 14 or 24 to allow a user to comfortably grasp the upper portion of elongated rod 96. An example of such a position for socket 92 is shown in FIG. 6. Rod 96 is easily demountable from socket 92 to facilitate transportation and storage of the water glider assembly.

In use, the user of the water glider assembly is able to grasp the elongated rod of the push and exert a force so as to propel the attached water glider member in a forward direction. Thus the push bar allows the user to use his whole body in propelling the water glider assembly which, among other things, considerably decreases the fatigue factor for the user's legs and may provide greater propulsion for the water glider assembly. Use of the elongated rod also helps in conducting the previously described turning procedure and for maintaining the user's balance during rough wave conditions. Finally, it should be noted that various modifications can be made in the described embodiments and still be within the scope of the invention. For example, one or more of the rollers of each guide element can be non-cylindrical in shape, provided that the parts of the stabilizer cartridge which they contact are correspondingly shaped. Indeed, the rollers may be replaced with other bearing devices as long as they will suitably slidingly engage the corresponding parts of the stabilizer cartridge. Further, the base plates of each guide element can be eliminated and the roller assemblies mounted directly onto the vertical wall portions of the indented steps of each glide member. It should also be recognized that the invidual water glider members can be constructed to have any desired types of control mechanisms along their bottoms, such as those shown in my U.S. Pat. No. 4,261,069. Furthermore, the releasable locking mechanism for the stabilizer cartridge of the type described may take many forms, the illustrated locking mechanism being a presently preferred embodiment.

I claim:

1. A water glider assembly comprising a right foot water glider member which includes a leading end, a trailing end, a top surface and a left side surface; said left side surface including an indented step which forms an elongated channel that extends from the leading end of said water glider member towards its trailing end; said right foot water glider member also including at least two guide elements connected thereto, a left foot water glider member which includes a leading end, a trailing end, a top surface and a right side surface; said right side surface including an indented step which forms an elongated channel that extends from the leading end of said water glider member towards its trailing end; said left foot water glider member also including at least two guide elements connected thereto, an elongated stabilizer cartridge which is capable of extending along the elongated channels in both said right and left foot water glider members and is cooperable with the guide elements of both said right and left foot water glider members to prevent lateral and vertical separation thereof and to prevent individual sideways rotation of each glider member, yet allow easy parallel movement of the water glider members by the user when moving himself across the surface of the water in which the assembly is located; and a releasable locking mechanism means for alternately locking the stabilizer cartridge to either the right or left water glider member and for releasing the stabilizer cartridge from the locked water glider member upon a forward movement of the other water glider member relative to the locked water glider member.

2. A water glider assembly as defined in claim 1 wherein the locking mechanism means comprises two spring-like locking fingers carried by the stabilizer cartridge, stop means carried on each of the water glider members, the stop means being engagable with the locking fingers to lock the stabilizer cartridge to a water glider member, and release means on each water glider member for releasing the locking finger engaged on a stop means carried by the other water gliding member.

3. A water glider assembly as defined in claim 2 wherein the stop means is a ratchet bar having a plurality of teeth.

4. A water glider assembly as defined in claim 2 wherein the locking mechanism means includes an upwardly projecting post on the stabilizer cartridge and the release means comprises a release arm having a striking surface adapted to contact the post of the stabilizer cartridge.

5. A water glider assembly as defined in claim 4 wherein the spring-like locking fingers project from the post on the stabilizer cartridge.

6. A water glider assembly as defined in claim 2 wherein the spring-like locking fingers are of a curved-configuration such that they diverge from one another as the fingers extend toward the leading ends of the water glider members.

7. A water glider assembly as defined in claim 1 wherein the locking mechanism means includes an upwardly projecting post on the stabilizer cartridge and an arm means on each water glider member, the arm means having a striking surface adapted to contact the post of the stabilizer cartridge.

8. A water glider assembly as defined in claim 7 wherein the locking mechanism means comprises two spring-like locking fingers carried by the stabilizer cartridge, stop means carried on each of the water glider members, the stop means being engagable with the locking fingers to lock the stabilizer cartridge to a water glider member, and release means on each water glider member for releasing the locking finger engaged on a stop means carried by the other water gliding member.

9. A water glider assembly as defined in claim 8 wherein the spring-like locking fingers project from the post on the stabilizer cartridge.

10. A water glider assembly as defined in claim 1 wherein the top surface of each water glider member has a socket thereon, each socket receiving an end of an elongated rod.

11. A water glider assembly as defined in claim 1 wherein each said guide element includes at least one roller assembly extending into the elongated channel of each water glider member.

12. The water glider assembly as defined in claim 1 wherein both the right foot water glider member and the left foot water glider includes three guide elements, the first of said three guide elements being located in the indented step of each water glider member near its leading end and the second and third of said three guide elements being located close together at a point about halfway between the leading and trailing ends of each water glider member.

13. The water glider assembly as defined in claim 1 wherein the indented step of both the right foot water glider member and left foot water glider member are formed by a vertical wall portion which extends downwardly from the glider member top surface, a horizontal wall portion and a rear end wall portion; and wherein each of said guide elements is mounted on an associated vertical wall portion.

14. The water glider assembly as defined in claim 1 wherein said elongated stabilizer cartridge includes a flat center member, two sets of spaced apart flat rib members which extend away from opposite sides of said flat center member, two cap members which are respectively connected to the upper and lower edges of said center member, and a flat closure member connected to one end of said elongated stabilizer cartridge to connect the adjacent ends of each of said center member, said rib members and said cap members.

* * * * *